US006248453B1

(12) United States Patent
Watson

(10) Patent No.: US 6,248,453 B1
(45) Date of Patent: Jun. 19, 2001

(54) HIGH STRENGTH ALUMINUM ALLOY

(75) Inventor: Thomas J. Watson, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/469,858

(22) Filed: Dec. 22, 1999

(51) Int. Cl.[7] ..... B32B 15/02

(52) U.S. Cl. ..... 428/614; 148/437; 148/438; 148/439; 148/440; 420/416; 420/528; 420/542; 428/548

(58) Field of Search ..... 428/614, 548; 148/437, 438, 439, 440; 420/416, 528, 542

(56) References Cited

U.S. PATENT DOCUMENTS

| | | | | |
|---|---|---|---|---|
| 4,259,112 | * | 3/1981 | Dolowy, Jr. et al. | 419/6 |
| 4,463,058 | * | 7/1984 | Hood et al. | 75/229 |
| 4,597,792 | * | 7/1986 | Webster | 75/249 |
| 4,647,321 | * | 3/1987 | Adam | 148/415 |
| 4,689,090 | * | 8/1987 | Sawtell et al. | 148/552 |
| 4,755,221 | * | 7/1988 | Paliwal et al. | 75/244 |
| 4,797,155 | * | 1/1989 | Das | 75/229 |
| 4,865,806 | * | 9/1989 | Skibo et al. | 420/129 |
| 4,874,440 | * | 10/1989 | Sawtell et al. | 148/437 |
| 5,055,257 | * | 10/1991 | Chakrabarti et al. | 148/438 |
| 5,226,983 | * | 7/1993 | Skinner et al. | 148/437 |
| 5,620,652 | * | 4/1997 | Tack et al. | 420/532 |

FOREIGN PATENT DOCUMENTS

| | | | |
|---|---|---|---|
| WO 95/32074 | * | 11/1995 | (WO) . |
| WO 96/10099 | * | 4/1996 | (WO) . |

* cited by examiner

*Primary Examiner*—Deborah Jones
*Assistant Examiner*—Robert R. Koehler
(74) *Attorney, Agent, or Firm*—Charles E. Sohl

(57) ABSTRACT

A high strength dispersion strengthened aluminum alloy comprising an aluminum solid solution matrix strengthened by a dispersion of particles based on the compound $Al_3X$, where $Al_3X$ has an $L1_2$ structure, is described. Various alloying elements are employed to modify the lattice parameter of the matrix and/or the particles so that the matrix and particles have similar lattice parameters. The alloy is produced by rapid solidification from the melt.

13 Claims, No Drawings

HIGH STRENGTH ALUMINUM ALLOY

BACKGROUND OF THE INVENTION

1. Field of the Invention

The present invention relates to an aluminum based alloy having excellent mechanical properties at up to about 300° C.

2. Description of Background Art

Aluminum and aluminum alloys have a combination of good mechanical properties and low density that make them useful for some aerospace applications. However, most prior aluminum alloys have had a maximum use temperature of about 150° C.

Prior attempts to improve the high temperature mechanical properties of aluminum alloys have included the addition of inert particles such as alumina into an aluminum matrix. The inert particles strengthen the alloy and help it to maintain properties at elevated temperatures. However, the benefits obtained in the addition of such particles are limited and such materials have not found widespread application.

Other attempts to improve the mechanical properties of aluminum have focused on the development of stable intermetallic particles in an aluminum matrix by rapid solidification. U.S. Pat. No. 4,647,321 is typical of such alloys. This type of alloy has generally been observed to undergo particle coarsening and resultant loss of mechanical properties during processing.

A limited number of alloys are known which contain the element scandium. One group of such alloys is typified by U.S. Pat. Nos. 4,689,090 and 4,874,440, in which scandium is described as promoting or enhancing superplasticity. Superplasticity is a condition wherein, at elevated temperatures, a material displays unusual amounts of ductility and can be readily formed into complex shapes. Superplasticity is generally regarded as incompatible with elevated temperature strength and stability.

Another patent WO 95/32074 suggests the use of scandium to enhance the weldability of aluminum alloys. Finally, U.S. Pat. No. 5,620,652 mentions the possible small amounts of scandium as grain refinement agents.

Other patents relating to scandium containing aluminum alloys include WO 96/10099.

None of these prior patents appear to suggest the use of scandium in an aluminum alloy for use at elevated temperatures.

SUMMARY OF THE INVENTION

According to the present invention, an aluminum alloy containing a dispersion of particles having $L1_2$ structure is described. The alloy is processed by rapid solidification. $Al_3Sc$ is an example of an $L1_2$ compound which may be dispersed in an aluminum solid solution matrix.

According to the present invention, intentional amounts of other alloying elements are made to modify the lattice parameter of the matrix and/or the $Al_3X$ $L1_2$ particulates; the alloying additions are selected in kind and amount so as to render the lattice parameter of the matrix and the particles essentially identical at the intended use temperature.

Both the aluminum solid solution matrix and the $Al_3X$ particulates have face centered cubic structures, and will be coherent when their respective lattice parameters are matched to within about 1% preferably to within about 0.5%, and most preferably to within about 0.25%. When the condition of substantial coherency is obtained, the particles are highly stable at elevated temperatures, and the mechanical properties of the material will remain high at elevated temperatures.

DETAILED DESCRIPTION OF THE PREFERRED EMBODIMENT

The present invention includes compositional, microstructural, and processing aspects. A broad exemplary range for an alloy according to the present invention includes 3–16 wt. % scandium, 3–6 wt. % magnesium, 2–5 zirconium, and 0.1–4 wt. % titanium.

An alloy of aluminum containing 3–16% Sc is a model alloy for explaining this invention. A simple binary alloy consisting of aluminum and 3–16 wt. % scandium will form an aluminum solid solution matrix containing trace amounts of scandium and a dispersion of $Al_3Sc$ particles having an $L1_2$ structure (an ordered FCC structure with Sc at the corner positions and Al on the cube faces). Such an alloy has little or no practical application at elevated temperatures because the matrix lattice parameter differs substantially from the lattice parameter of the $Al_3Sc$ particles. In the case of a simple binary alloy, the difference in lattice parameters results in a relatively high interfacial energy at the interfaces between the matrix and the particles as well as stresses and strains relating to the lack of coherency. These factors contribute to relatively high diffusion rates at elevated temperatures and cause coarsening of the particles under conditions of stress at elevated temperature. Accordingly, such a simple binary alloy is not suited for use at elevated temperatures (greater than about 150° C.).

The present invention material solves these drawbacks by alloying additions to render the matrix and $Al_3X$ particulate lattice parameters essentially identical.

The matrix is an aluminum solid solution whose lattice parameter has been modified by additions of one or more alloying elements selected from the group consisting of Mg, Ag, Zn, Li and Cu.

Table I illustrates the effect of 1 wt % of each of these elements on the lattice parameter of aluminum at room temperature.

TABLE I

| Element Added | Change in Lattice Parameter |
|---|---|
| None (Pure Al) | 4.049 A° |
| Mg | +0.0052 A° |
| Ag | +0.00002 A° |
| Zn | −0.0003 A° |
| Li | −0.0005 A° |
| Cu | −0.0022 A° |

The elements Mg, Ag, Zn, Cu and Li are utilized because they partition to the aluminum solid solution matrix, they modify the lattice parameter of aluminum, and they have high solid solubility in aluminum. The skilled artisan can use the information in Table I to estimate how much of an alloying element, or combination of elements in Table I will be required to produce an aluminum solid solution matrix with a particular lattice parameter.

Several elements form precipitates having the desired equilibrium $L1_2$ structure when added to Al. Other elements form metastable $L1_2$ structure phases when added to aluminum, their equilibrium structures may be $D0_{22}$ or $D0_{23}$.

It can be demonstrated that adding metastable $L1_2$ formers in combination with equilibrium $L1_2$ formers will produce an equilibrium $L1_2$ structure when the atomic % of the metastable $L1_2$ forming element(s) in the compound is less than about 50% of the total equilibrium $L1_2$ forming elements, and preferably less than about 25%.

Table II lists the $Al_3X$ $L1_2$ lattice parameter at room temperature for of a variety of elements; Ti, Nb, V, and Zr are metastable $L1_2$ formers. Sc, Er, Lu, Yb, Tm and U are stable $L1_2$ formers.

Since the lattice parameter of Al is less than that of the equilibrium $L1_2$ formers, it is logical to prefer that at least a portion of the "X" additions be chosen from those that form equilibrium $L1_2$ particles with the smallest lattice parameters, Sc, Er and Lu are thus preferred. Preferably at least 10% of the "X" atoms are Sc.

The volume fraction of the $Al_3X$ $L1_2$ phase is preferably from about 10 to about 70% by volume.

TABLE II

| X | $Al_3X$ lattice parameter, A° @ Room Temperature |
|---|---|
| Ti | 3.967 (1) |
| Nb | 3.991 (1) |
| V | 4.045 (1) |
| Zr | 4.085 (2) |
| Sc | 4.101 (3) |
| Er | 4.167 (3) |
| Lu | 4.187 (3) |
| Yb | 4.202 (3) |
| Tm | 4.203 (3) |
| U | 4.267 (3) |
| Pure Al | 4.049 |

(1) equilibrium $Al_3X$ structure is $D0_{22}$
(2) equilibrium $Al_3X$ structure is $D0_{23}$
(3) equilibrium $Al_3X$ structure is $L1_2$ Because high temperature stability is desired in this alloy, it is preferred to add zirconium because zirconium has an exceptionally low diffusion coefficient in aluminum. Low diffusion coefficients predict low rates of diffusion and low rates of diffusion are desired in order to minimize particle coarsening during long exposures at elevated temperatures. Preferably at least 10% of the "X" atoms are Zr.

At 500° F. the diffusion coefficient of scandium in aluminum is about $2.9\times10^{-18}$. The diffusion coefficient of titanium in aluminum is about $1.3\times10^{-17}$ at the same temperature meaning that titanium diffuses in aluminum more readily than does scandium. The diffusion coefficient of zirconium in aluminum is only $1.4\times10^{-21}$, meaning that the diffusion rate of zirconium in aluminum is three orders of magnitude less than the rate of diffusion of scandium in aluminum. Since zirconium forms the desired $L1_2$ phase (albeit metastable) in aluminum, I prefer to add zirconium for diffusional stability. I also prefer that at least 10% of the "X" atoms are Ti.

Chromium is another element which might be added in small quantities to improve diffusional stability, since Cr has a diffusion coefficient of about $2.3\times10^{-22}$ at 500° F. However, chromium is not preferred because binary alloys of aluminum chromium do not form an $L1_2$ phase. Consequently, if chromium is added, care must be taken that the amount of chromium is low enough as not to cause the precipitation of extraneous non $L1_2$ phases. Chromium, if added should preferably be present in amounts of less than about 1% by weight.

In all cases, the skilled artisan will recognize the desirability of evaluating compositions after exposure at long times at elevated temperatures for the presence of extraneous phases which do not have the $L1_2$ structure and which may cause deleterious properties. I broadly prefer to have less than 5 vol % of such phase, and most prefer to have less than 1 vol % of such phases.

Example alloys which are currently preferred include (by wt.):

a. 4% Sc, 11.9% Er, 3.0% Ti, 2.5% Zr, bal Al. This is a calculated composition which has been produced, but not yet evaluated. The matrix and particle lattice parameters should be essentially identical at an intended use temperature of 300° C. and the alloy should contain about 30% by volume of the $L1_2$ phase.
b. 6% Mg, 4% Sc, 11.9% Er, 3.0% Ti, 2.5% Zr, bal Al. This is a calculated alloy composition which has been produced but not yet evaluated. The matrix and particle lattice parameters should be essentially identical at an intended use temperature of 190° C. and the alloy should contain about 30 volume % of the $L1_2$ phase.
c. 30% Sc, 60% Mg, 3.0% Ti, 2.5% Zr. This is a calculated alloy whose matrix and particle lattice parameters should be essentially identical at 190° C. and the alloy should contain about 13 volume % of the $L1_2$ phase.

Extensive research has been performed for more than 50 years in the field of nickel superalloys. The majority of nickel base superalloy materials comprise a nickel solid solution, face centered cubic, matrix containing a dispersion of $Ni_3Al$. The $Ni_3Al$ phase is a face centered cubic ordered phase of the $L1_2$ type. Nickel base superalloys maintain high degrees of strength at temperatures very near their melting point and it is generally accepted that it is desirable in nickel base superalloys for the lattice parameter of the precipitate particles to be substantially equal to the lattice parameter of the matrix phase at the use temperatures. Researchers in the field of nickel base superalloys suggests that the strength contribution of the $Ni_3Al$ particles is due to the formation of antiphase boundaries as dislocations pass through the ordered particles.

Deformation in metallic materials occurs as a consequence of the motion of defects known as dislocations, which pass through the crystal structure in response to applied stress. In the case of ordered $L1_2$ particles in a face centered cubic matrix having an identical or nearly identical lattice parameter, a single protect or unit dislocation in the matrix material can split into two partial dislocations separated by an antiphase boundary in order to pass through the ordered $L1_2$ particles. The energy required to split a single dislocation into two partial dislocations and to create the antiphase boundary which separates the two partial dislocations is generally believed to contribute to the strengthening which is observed in gamma/gamma prime superalloys at elevated temperature.

I believe, without wishing to be bound by this belief, that the strengthening mechanism in my present invention aluminum alloys is analogous to that which has previously been described in the generally unrelated area of nickel base superalloys.

The $L1_2$ particles found in the invention alloy are essentially equilibrium phases and are stable over a wide temperature range.

However, in the alloys of the present invention, the amount of scandium which is soluble in aluminum varies only very slightly from room temperatures up to temperatures in excess of 300° C. This means that $Al_3Sc$ phase particles, for example, in the present invention are stable at elevated temperatures and that the invention alloys are thermally stable at elevated temperatures and can withstand long exposures at high temperatures. However, this also means the alloy is not particularly susceptible to heat treatment and it also means that the distribution and size of the precipitate particles is controlled by the rate of solidification from the liquid to solid states.

In order to get the fine dispersion of $Al_3X$ $L1_2$ particles which is required to produce useful amounts of strengthening at elevated temperatures, it is generally necessary to solidify the invention materials from the liquid state at a rapid rate. The cooling rate required varies with the type and amount of "X" type elements present in the alloy, higher amounts of X and similar elements generally require a higher degree of cooling in order to maintain a fine dispersion.

For scandium contents of about 4 wt %, cooling rates of about $10^5$ to $10^{6°}$ C./sec. appear to be necessary to get the required fine particle dispersion. The skilled artisan will be able to readily determine the required rate using only very limited amounts of experimentation.

It is desired that essentially all of the particles have an average size of less than about 500 nm and preferably less than about 250 nm and preferably that more than 10% of the particles have a diameter of less than 100 nm. In this invention material, the presence of larger particles will not be detrimental, especially for creep, but it will be found necessary to have a certain volume fraction of particles in the above size ranges present in order to provide the useful strength properties.

While rapid solidification is required for the manufacture of the invention material, the rate ($10^{4°}$ C. to $10^{8°}$ C./se) is important, but the particular solidification technique is not. Appropriate methods include, without limitation, gas atomization and melt-spinning. Such rapid solidification techniques generally produce powder, fibers or ribbons which must be consolidated to form useful articles.

Known consolidation techniques including vacuum hot pressing, HIPping, and extrusion of canned powder and it does not appear that any particular consolidation technique is critical to the success of the invention. However, consolidation must be performed in a vacuum or inert atmosphere in order to avoid oxidation. We believe that consolidation at temperatures between about 200° C. and 500° C. and pressures of about 5 to 25 ksi for times of from 5 to 20 hours are generally appropriate. We have consolidated invention material using a blind die and punch. Other processes such as a hot rolling and extrusion may also be appropriate.

The invention alloys may be used to form components of mechanical devices, especially devices such as the compressor section of a gas turbine engine where low weight is required and temperatures on the order of 300° C. are encountered.

The invention material may be used in a bulk form, it may also be used as a matrix material for composites.

Such composites will comprise the invention material (Al solid solution matrix containing coherent $L1_2$ $Al_3X$ particles) as a matrix containing a reinforcing second phase which may be in the form of particles, whiskers, fibers (which may be braided or woven fiber tows) and ribbons.

The reinforcing phase in a composite application should not be confused with the $Al_3X$ $L1_2$ phase in the invention material. The $Al_3X$ $L1_2$ particles will typically be less than 100 nm in diameter, reinforcing phases added to metal matrix composites usually have minimum dimensions which are greater than 500 nm, typically 2–20 $\mu$m.

Suitable reinforcement materials include oxides, carbides, nitrides, carbonitrides, silicides, borides, boron, graphite, ferrous alloys, tungsten, titanium and mixtures thereof. Specific reinforcing materials include SiC, $Si_3N_4$, Boron, Graphite, $Al_2O_3$, $B_4$ C, $Y_2O_3$, $MgAl_2O_4$, and mixtures thereof. These reinforcing materials may be present in volume fractions of up to about 60 vol % and preferably 5–60 vol % and more preferably 5–20 vol. %.

U.S. Pat. Nos. 4,259,112; 4,463,058; 4,597,792; 4,755,221; 4,797,155; and 4,865,806 describe methods of producing metal matrix composites and these patents are expressly incorporated herein by reference.

What is claimed is:

1. An aluminum material comprising:

an aluminum solid solution matrix containing 10–70 vol % of an $Al_3X$ phase having an $L1_2$ structure where X is selected from the group consisting of Sc, Er, Lu, Yb, Tm and U, and mixtures thereof and further containing Ti, Nb, V, Zr, and Cr in amounts insufficient to cause the formation of more than about 5 vol % of non $L1_2$ structure phases and wherein the aluminum solid solution matrix contains at least one element selected from the group consisting of Mg, Ag, Zn, Li, Cu and mixtures thereof.

2. A material as in claim 1 wherein the lattice parameter of the aluminum solid solution matrix is greater than the lattice parameter of pure aluminum.

3. A material as in claim 1 wherein the lattice parameter of the $Al_3X$ $L1_2$ phase is less than the lattice parameter of $Al_3Sc$.

4. A material as in claim 1 wherein the lattice parameter of the aluminum solid solution matrix is greater than the lattice parameter of pure aluminum, and the lattice parameter of the $Al_3X$ $L1_2$ phase is less than the lattice parameter of $Al_3Sc$.

5. A material as in claim 1 wherein, the lattice parameter of aluminum solid solution matrix is within 1% of the lattice parameter of the $Al_3X$ phase at the intended use temperature.

6. A material as in claim 1 wherein, the lattice parameter of aluminum solid solution matrix is within 0.5% of the lattice parameter of the $Al_3X$ phase at the intended use temperature.

7. A material as in claim 1 wherein, the lattice parameter of aluminum solid solution matrix is within 0.25% of the lattice parameter of the $Al_3X$ phase at the intended use temperature.

8. A material as in claim 1 wherein said $Al_3X$ phase is present in the form of particles and wherein more than 10% of said particles are less than 100 nm in diameter.

9. A material as in claim 1 wherein, on an atomic basis, at least 10% of X is Sc.

10. A material as in claim 1 wherein, on an atomic basis, at least 10% of X is Zr.

11. A material as in claim 1 where, on an atomic basis, at least 10% of X is Ti.

12. A metal matrix composite containing a reinforcing second phase which comprises:

a) an aluminum alloy matrix which comprises an aluminum solid solution matrix containing a dispersion of $Al_3X$ particles having a $L1_2$ crystal structure whose average size is less than about 250 nm, said matrix having a lattice parameter which is within 1% of the lattice parameter of the $L1_2Al_3X$ particles, b) a reinforcing second phase whose geometry is selected from the group consisting of particles, fibers, woven fibers, braided fibers, fiber tows, particles, whiskers and ribbons and combinations thereof, and whose composition is selected from the group consisting of oxides, carbides, nitrides, carbonitrides, silicides, borides, boron, graphite, ferrous alloys, tungsten, and titanium and mixtures thereof; said reinforcing second phase being present in an amount of from about 5 to 60 vol %.

13. An aluminum alloy as in claim 12, comprising $L1_2$ particles in an aluminum solid solution matrix, wherein said alloy serves as a matrix to contain from about 5 to 20 vol. % of a reinforcing phase, where said reinforcing phase is selected from the group consisting of SiC, $Si_3N_4$, Boron, Graphite, $Al_2O_3$, $B_4C$, $Y_2O_3$, $MgAl_2O_4$ and combinations thereof, said reinforcing phase being non-coherent with said matrix alloy.

* * * * *

UNITED STATES PATENT AND TRADEMARK OFFICE

CERTIFICATE OF CORRECTION

PATENT NO. : 6,248,453 B1
DATED : June 19, 2001
INVENTOR(S) : Watson

It is certified that error appears in the above-identified patent and that said Letters Patent is hereby corrected as shown below:

Column 4,
Line 19, delete "30% Sc, 60% Mg" and insert -- 3.0% Sc, 6.0% Mg -- therefor.

Signed and Sealed this

Twenty-ninth Day of June, 2004

JON W. DUDAS
*Acting Director of the United States Patent and Trademark Office*